US009723684B2

(12) United States Patent
Zhang

(10) Patent No.: US 9,723,684 B2
(45) Date of Patent: Aug. 1, 2017

(54) LED BACKLIGHT DRIVING CIRCUIT

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology, Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 14/786,016

(22) PCT Filed: Jun. 25, 2015

(86) PCT No.: PCT/CN2015/082356
§ 371 (c)(1),
(2) Date: Dec. 31, 2015

(87) PCT Pub. No.: WO2016/183903
PCT Pub. Date: Nov. 24, 2016

(65) Prior Publication Data

US 2017/0150572 A1 May 25, 2017

(30) Foreign Application Priority Data

May 19, 2015 (CN) ..... 2015 1 0257809

(51) Int. Cl.
*H05B 33/08* (2006.01)
*H05B 41/285* (2006.01)

(52) U.S. Cl.
CPC ..... *H05B 33/0887* (2013.01); *H05B 33/0815* (2013.01); *H05B 33/0827* (2013.01); *H05B 41/2855* (2013.01)

(58) Field of Classification Search
USPC .... 315/247, 224, 225, 185 S, 291, 307–326, 315/209 R, 246
See application file for complete search history.

(56) References Cited

U.S. PATENT DOCUMENTS

2013/0015781 A1* 1/2013 Kanemitsu ..... H05B 33/0815 315/291

* cited by examiner

*Primary Examiner* — Tuyet Vo
(74) *Attorney, Agent, or Firm* — Kim Winston LLP

(57) ABSTRACT

An LED backlight driving circuit is disclosed. The present disclosure relates to the technical field of display, whereby the technical problem of the incorrect detection of the short circuit detection module when the open circuit malfunction occurs to one LED backlight unit and the output voltage of the LED backlight driving circuit rises can be solved.

10 Claims, 2 Drawing Sheets

LED BACKLIGHT DRIVING CIRCUIT

CROSS REFERENCE TO RELATED APPLICATION

The present application claims benefit of Chinese patent application CN 201510257809.7, entitled "LED Backlight Driving Circuit" and filed on May 19, 2015, the entirety of which is incorporated herein by reference.

FIELD OF THE INVENTION

The present disclosure relates to the technical filed of display, and particularly to an LED backlight driving circuit.

BACKGROUND OF THE INVENTION

At present, the Light-Emitting Diode (LED) backlight circuit has become a new trend in backlight technology by virtue of its advantages of a light and thin structure, a low power consumption, a high light-emitting efficiency, a desirable color performance ability, and so on. The LED backlight circuits are increasingly selected to be the backlight circuits that are used in Liquid Crystal Display (LCD) and other display devices.

Each LED backlight circuit is provided with a plurality of LED backlight units, and each LED backlight unit comprises a plurality of LEDs that are in series connection with one another. In order to guarantee the normal work of the LED backlight circuit, the LED backlight driving circuit which is used for driving the LED backlight circuit comprises an open circuit detection module that is used for detecting an open circuit malfunction of the LED backlight unit, and a short circuit detection module that is used for detecting a short circuit malfunction of the LED backlight unit. It is discovered that, when the open circuit malfunction occurs to one LED backlight unit, the LED backlight driving circuit can detect that there is no current in the LED backlight unit. Then, the LED backlight driving circuit outputs a higher voltage to the LED backlight circuit, so as to determine whether the difference among the LED backlight units (for example, the changes of the impedance thereof) results in that the operating voltage of the LED backlight unit rises. When the voltage output by the LED backlight driving circuit rises to a certain extent, the short circuit detection module would detect incorrectly that the short circuit malfunction occurs to other LED backlight units to which the open circuit malfunction does not occur. Under such circumstances, the LED backlight driving circuit would receive a notification from the short circuit detection module, and then turn off the LED backlight units that are detected by the short circuit detection module incorrectly. Consequently, the whole LED backlight circuit cannot work normally.

SUMMARY OF THE INVENTION

The present disclosure aims to provide an LED backlight driving circuit so as to solve the technical problem of the incorrect detection of the short circuit detection module when the open circuit malfunction occurs to one LED backlight unit and the output voltage of the LED backlight driving circuit rises.

The present disclosure provides an LED backlight driving circuit, used for driving an LED backlight circuit, the LED backlight circuit comprising at least one LED backlight unit, wherein the LED backlight driving circuit comprises an open circuit detection module that is used for detecting an open circuit malfunction of the LED backlight unit, a short circuit detection module that is used for detecting a short circuit malfunction of the LED backlight unit, and a regulation module; and wherein the regulation module is configured to turn off the short circuit detection module when the open circuit malfunction occurs to the LED backlight unit and an output voltage of a voltage output end of the LED backlight driving circuit rises, and to turn on the short circuit detection module when the LED backlight unit to which the open circuit malfunction occurs is turned off the by the LED backlight driving circuit and the output voltage of the voltage output end of the LED backlight driving circuit declines.

An input end of the regulation module is connected with an input end of the open circuit detection module, and an output end of the regulation module is connected with an input end of the short circuit detection module.

The open circuit detection module comprises a first resistor, a second resistor, and a first operational amplifier; one end of the first resistor is connected with one end of the second resistor, the other end of the first resistor is connected with the voltage output end of the LED backlight driving circuit, and the other end of the second resistor is connected with the ground; and an inverting input end of the first operational amplifier is connected with a first voltage end, and a non-inverting input end thereof is connected with a connection position of the first resistor and the second resistor.

The short circuit detection module comprises a third resistor, a fourth resistor, and a second operational amplifier; one end of the third resistor is connected with one end of the fourth resistor, the other end of the third resistor is connected with a second voltage end, and the other end of the fourth resistor is connected with the ground; and an inverting input end of the second operational amplifier is connected with a connection position of the third resistor and the fourth resistor.

The regulation module comprises a third operational amplifier, a first switching transistor, and a second switching transistor; and the first switching transistor is an N-type switching transistor, and the second switching transistor is a P-type switching transistor.

A non-inverting input end of the third operational amplifier is connected with the connection position of the first resistor and the second resistor, an inverting input end thereof is connected with a third voltage end, and an output end thereof is connected with a first end of the first switching transistor and a first end of the second switching transistor; a second end of the first switching transistor is connected with the ground, and a third end thereof is connected with a non-inverting input end of the second operational amplifier; and a second end of the second switching transistor is connected with the non-inverting input end of the second operational amplifier, and a third end thereof is connected with one end of the LED backlight unit far from the voltage output end.

The first switching transistor is an N-type Metal-Oxide-Semiconductor Field-Effect Transistor (MOSFET), and the second switching transistor is a P-type MOSFET.

The LED backlight driving circuit further comprises an LED constant current driving circuit, wherein the LED constant current driving circuit comprises a driving signal control module; and wherein the driving signal control module is connected with a gate of a MOSFET, a source of the MOSFET is connected with the ground, and a drain of the MOSFET is connected with the voltage output end of the LED backlight driving circuit.

The LED constant current driving circuit further comprises a current control module; the current control module is connected with each LED backlight unit, an output end of the open circuit detection module, an output end of the short circuit detection module, and the driving signal control module; and the current control module enables the driving signal control module to turn on or turn off the MOSFET according to output signals of the output end of the open circuit detection module and the output end of the short circuit detection module.

An inductor is arranged between a voltage input end of the LED backlight driving circuit and the drain of the MOSFET, and a diode is arranged between the drain of the MOSFET and the voltage output end; and the drain of the MOSFET is connected with a positive pole of the diode, and the voltage output end is connected with a negative pole of the diode.

The following beneficial effects can be brought about by the present disclosure. The embodiment of the present disclosure provides an LED backlight driving circuit, which comprises a regulation module. The design difficulty of the LED backlight driving circuit can be reduced by the regulation module, and at the same time, the technical problem of the incorrect detection of the short circuit detection module when the open circuit malfunction occurs to one LED backlight unit and the output voltage of the LED backlight driving circuit rises can be solved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The drawings necessary for explaining the embodiments are introduced briefly below to illustrate the technical solutions of the embodiments of the present disclosure more clearly.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Figure 1:
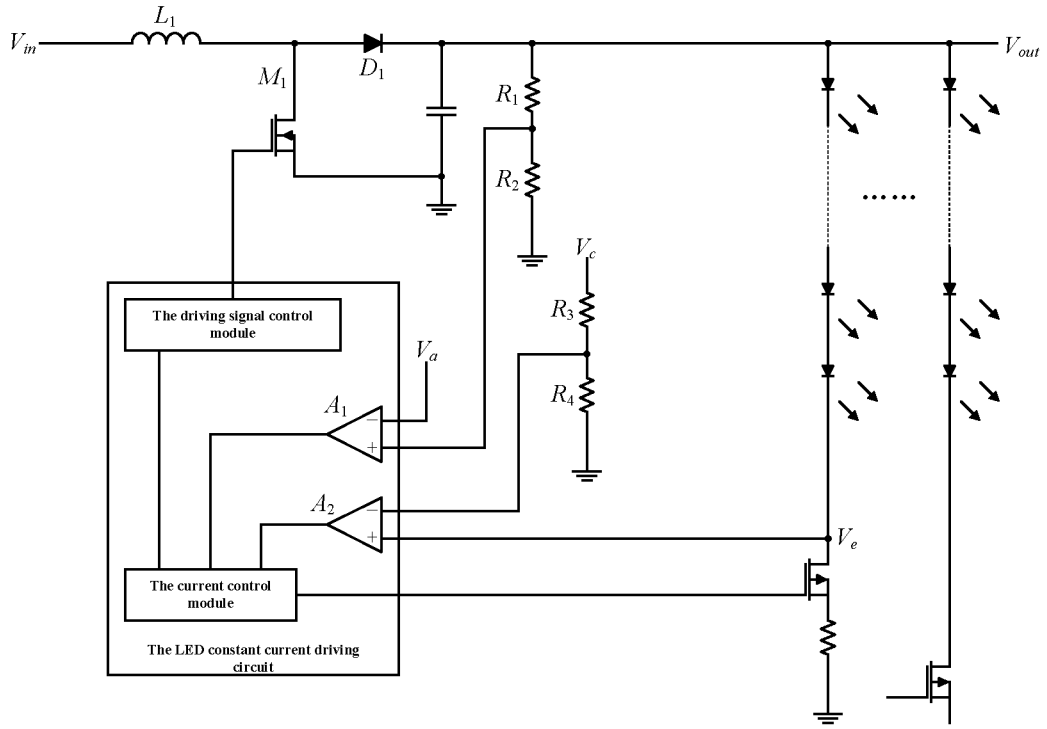
FIG. 1 schematically shows a structure of an LED backlight driving circuit in the prior art.

As shown in FIG. 1, an LED backlight driving circuit in the prior art is provided with an LED constant current driving circuit. A driving signal control module in the LED constant current driving circuit is connected with a gate of a Metal-Oxide-Semiconductor Field-Effect Transistor (MOSFET), i.e., $M_1$, a source of $M_1$ is connected with the ground, and a drain of $M_1$ is connected with a voltage output end $V_{out}$ of the LED backlight driving circuit through a diode $D_1$. A positive pole of the diode $D_1$ is connected with the drain of $M_1$, and a negative pole of the diode $D_1$ is connected with the voltage output end $V_{out}$, so as to prevent a countercurrent from the voltage output end $V_{out}$ to a voltage input end $V_{in}$.

The driving signal control module charges an inductor $L_1$ with one end of which is connected with the drain of $M_1$, and the other end of which is connected with the voltage input end $V_{in}$ continuously for a certain time period through turning on $M_1$, so that an output voltage of the voltage output end $V_{out}$ can reach a high-level voltage by which each LED backlight unit of an LED backlight circuit can be activated.

In order to detect the abnormal conditions of the LED backlight circuit, the LED backlight driving circuit is provided with an open circuit detection module that is used for detecting an open circuit malfunction of the LED backlight unit, and a short circuit detection module that is used for detecting a short circuit malfunction of the LED backlight unit.

Figure 2:
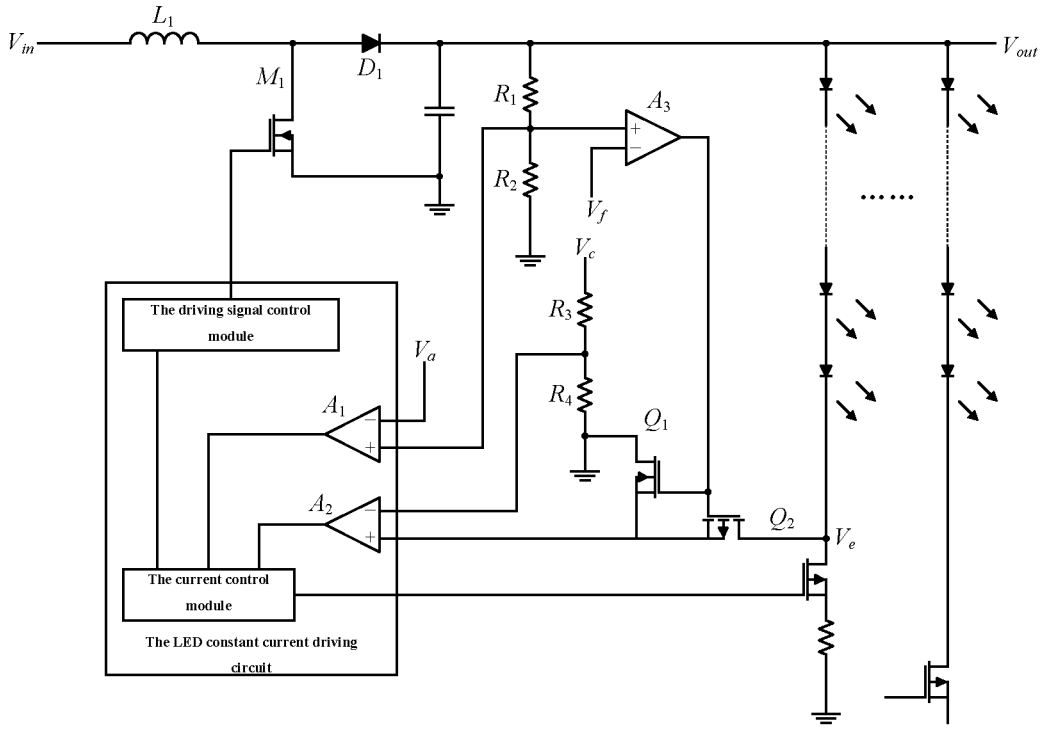
FIG. 2 schematically shows a structure of an LED backlight driving circuit according to an embodiment of the present disclosure.

In addition, the LED constant current driving circuit is further provided with a current control module, which is connected with each LED backlight unit, an output end of the open circuit detection module, an output end of the short circuit detection module, and the driving signal control module. The current control module enables the driving signal control module to turn on or turn off $M_1$ according to output signals of the output end of the open circuit detection module and the output end of the short circuit detection module. One end (which is referred to as a negative end hereinafter) of each LED unit far from the voltage output end Void is connected with the ground through a MOSFET and a resistor, and the MOSFET of each LED unit is controlled by the current control module. The current control module can turns on or turns off the LED unit through outputting a corresponding electric signal to the MOSFET of each LED unit. FIG. 1 and FIG. 2 only schematically show the MOSFET and the resistor of one LED unit completely, and the connection situation of other LED units is the same as that of this LED unit. The details of which are no longer repeated here.

As shown in FIG. 1, the open circuit detection module in the prior art comprises a first resistor $R_1$, a second resistor $R_2$, and a first operational amplifier $A_1$. One end of the first resistor $R_1$ is connected with one end of the second resistor $R_2$, the other end of the first resistor $R_1$ is connected with the voltage output end $V_{out}$ of the LED backlight driving circuit, and the other end of the second resistor $R_2$ is connected with the ground. An inverting input end of the first operational amplifier $A_1$ is connected with a first voltage end $V_a$, and a non-inverting input end thereof is connected with a connection position of the first resistor $R_1$ and the second resistor $R_2$.

The short circuit detection module comprises a third resistor $R_3$, a fourth resistor $R_4$, and a second operational amplifier $A_2$. One end of the third resistor $R_3$ is connected with one end of the fourth resistor $R_4$, the other end of the third resistor $R_3$ is connected with a second voltage end $V_c$, and the other end of the fourth resistor $R_4$ is connected with the ground. An inverting input end of the second operational amplifier $A_2$ is connected with a connection position of the third resistor $R_3$ and the fourth resistor $R_4$, and a non-inverting input end thereof is connected with the negative end of the LED backlight unit.

The open circuit protection voltage of the open circuit detection module is set according to a voltage needed by the LED backlight unit and the withstand voltages of the components of the LED backlight driving circuit. The open circuit protection voltage should be larger than the voltage needed by the LED backlight unit while less than the withstand voltages of the components of the LED backlight driving circuit. As shown in FIG. 1, when the values of the first resistor $R_1$ and the second resistor $R_2$ are determined, the open circuit protection voltage $V_b$ can be obtained through the following formula:

$$V_b = \frac{V_a}{R_2} \times (R_1 + R_2).$$

The inverting input end of the first operational amplifier $A_1$ is connected with a first voltage end $V_a$, and the output signal of the first operational amplifier $A_1$ can have a low-level voltage (0 V) as long as the voltage of the non-inverting input end of the first operational amplifier $A_1$ is lower than a voltage $V_a$ output by the first voltage end $V_a$. When the open circuit malfunction occurs to one LED backlight unit, the open circuit detection module of the LED backlight driving circuit can detect that there is no current in the LED backlight unit. At this time, the current control module sends a signal to the driving signal control module, and the driving signal control module turns on $M_1$ accordingly. In this case, the inductor $L_1$ is charged, and the output voltage of the voltage output end $V_{out}$ is improved to the value of the open circuit protection voltage $V_b$ so as to exclude the possibility that the difference among the LED backlight units (for example, the changes of the impedance thereof) results in that the operating voltage of the LED backlight unit rises.

Similar to the open circuit detection module, a short circuit protection voltage $V_d$ is set with the short circuit detection module. The short circuit protection voltage $V_d$ is determined by a partial voltage of the second voltage end $V_c$ on the third resistor $R_3$ and the fourth resistor $R_4$, and thus $$V_d = \frac{V_c}{R_3 + R_4} \times R_4.$$

When the short circuit malfunction occurs to one LED backlight unit, and an excess voltage $V_e$ of the negative end of the LED backlight unit is larger than the short circuit protection voltage $V_d$, the output signal of the second operational amplifier $A_2$ of the short circuit detection module jumps from the low-level voltage (0 V) to a high-level voltage (3.3 V). The LED backlight unit to which the short circuit malfunction occurs will not be controlled when the current control module detects that the output signal of the second operational amplifier $A_2$ jumps.

On this premise, when the open circuit malfunction occurs to one LED backlight unit, during the procedure when the output voltage of the voltage output end $V_{out}$ of the LED backlight driving circuit is improved from the normal value $V_{out}$ to the open circuit protection voltage $V_b$, the negative end of each of the other LED backlight units which are in the normal work state would have the excess voltage $V_e$. If the excess voltage $V_e$ rises to a level which is higher than the short circuit protection voltage $V_d$ of the LED backlight driving circuit, other LED backlight units which are in the normal work state would be turned off by the LED constant current driving circuit. Consequently, the whole LED backlight circuit cannot work normally, and thus the display device cannot display images as usual.

In the prior art, in order to avoid the aforesaid abnormal conditions, the current and voltage characteristics of each LED backlight unit, and the difference among the characteristics of the LEDs and the LED backlight units should be taken into full consideration when the values of $R_1$, $R_2$, $R_3$, $R_4$, the open circuit protection voltage $V_b$, and the short circuit protection voltage $V_d$ are selected. Therefore, the design difficulty of the protection function thereof is increased.

In order to reduce the design difficulty of the LED backlight driving circuit and solve the technical problem of the incorrect detection of the short circuit detection module when the open circuit malfunction occurs to one LED backlight unit and the output voltage of the LED backlight driving circuit rises, the embodiment of the present disclosure provides an LED backlight driving circuit. As shown in FIG. 2, in addition to the open circuit detection module and the short circuit detection module, the LED backlight driving circuit further comprises a regulation module. An input end of the regulation module is connected with an input end of the open circuit detection module, and an output end of the regulation module is connected with an input end of the short circuit detection module. The regulation module can turn off the short circuit detection module when the open circuit malfunction occurs to an LED backlight unit and an output voltage of a voltage output end $V_{out}$ of the LED backlight driving circuit rises. In addition, the regulation module can turn on the short circuit detection module when the open circuit malfunction of the LED backlight unit is solved or when the LED backlight unit is turned off by the LED backlight driving circuit and the output voltage of the voltage output end $V_{out}$ of the LED backlight driving circuit declines. In this case, the short circuit detection module can detect the short circuit malfunction of each LED backlight unit once again, and it can be guaranteed that the LED backlight driving circuit works normally.

The regulation module comprises a third operational amplifier $A_3$, a first switching transistor $Q_1$, and a second switching transistor $Q_2$, wherein the first switching transistor $Q_1$ is an N-type switching transistor, and the second switching transistor $Q_2$ is a P-type switching transistor. Specifically, the first switching transistor $Q_1$ can be an N-type MOSFET, and the second switching transistor $Q_2$ can be a P-type MOSFET.

As shown in FIG. 2, a non-inverting input end of the third operational amplifier $A_3$ is connected with the connection position of the first resistor $R_1$ and the second resistor $R_2$, an inverting input end thereof is connected with a third voltage end $V_f$, and an output end thereof is connected with a first end of the first switching transistor $Q_1$ and a first end of the second switching transistor $Q_2$; a second end of the first switching transistor $Q_1$ is connected with the ground, and a third end thereof is connected with a non-inverting input end of the second operational amplifier $A_2$; and a second end of the second switching transistor $Q_2$ is connected with the non-inverting input end of the second operational amplifier $A_2$, and a third end thereof is connected with the negative end of the LED backlight unit. The first end is a gate, the second end can be a drain, and the third end can be a source; or the first end is a gate, the second end is a source, and the third end is a drain.

It is obvious that, in order to cooperate with the regulation module, some modifications should be made to the short circuit detection module. Specifically, the non-inverting input end of the second operational amplifier $A_2$ is not connected with the negative end of the LED backlight unit directly, but connected with the negative end of the LED backlight unit through the second switching transistor $Q_2$.

In the LED backlight driving circuit according to the embodiment of the present disclosure, when the open circuit malfunction occurs to one LED backlight unit, the current control module of the LED backlight driving circuit can detect that there is no current in the LED backlight unit. The current control module sends a signal to the driving signal control module, so that $M_1$ is turned on, the inductor $L_1$ is charged, and the output voltage of the voltage output end $V_{out}$ is improved. Since the LED backlight driving circuit is provided with the regulation module, an output voltage of a third voltage end $V_f$ that is connected with the inverting input end of the third operational amplifier $A_3$ of the regulation module is 0.2 to 0.5 V less than the voltage $$\frac{V_{out}+V_d}{R_1+R_2}\times R_2,$$

wherein $V_{out}$ is the output voltage of the voltage output end $V_{out}$ when the LED backlight unit each are in the normal work state. The purpose that the output voltage of the third voltage end $V_f$ is configured in the above manner is to avoid the incorrect detection of the short circuit detection module resulted from the excess voltage $V_e$ of the negative ends of other LED backlight units which are in the normal work state higher than the short circuit protection voltage $V_d$ of the short circuit detection module after the output voltage of the voltage output end is improved and before the regulation module plays its role.

When the output voltage of the voltage output end $V_{out}$ rises, the voltage input into the non-inverting input end of the third operational amplifier $A_3$ rises accordingly. When the voltage input into the non-inverting input end reaches $$\frac{V_{out}+V_d}{R_1+R_2}\times R_2,$$

the output signal of the third operational amplifier $A_3$ jumps from the low-level voltage (0 V) to the high-level voltage (3.3 V), so that the first switching transistor $Q_1$ is turned on, while the second switching transistor $Q_2$ is turned off. As a result, the connection between the non-inverting input end of the second operational amplifier $A_2$ of the short circuit detection module and the LED backlight units is tuned off, and the non-inverting input end of the second operational amplifier $A_2$ of the short circuit detection module is connected with the ground. In this case, the voltage input into the non-inverting input end of the second operational amplifier $A_2$ is 0 V, which is always less than the short circuit protection voltage $V_d$. Therefore, the output voltage of the second operational amplifier $A_2$ is always in the low-level state, and the output voltage of the voltage output end $V_{out}$ can still be improved by the driving signal control module under the control of the current control module.

If the output voltage of the voltage output end $V_{out}$ continues to rise, the voltage input into the non-inverting input end of the first operational amplifier $A_1$ of the open circuit detection module is higher than $V_a$, and the output signal of the first operational amplifier $A_1$ jumps from the low-level voltage (0 V) to the high-level voltage (3.3 V), the LED backlight unit to which the open circuit malfunction occurs can be turned off by the current control module. At the same time, the time period during which $M_1$ is turned on can be reduced, and the output voltage of the voltage output end $V_{out}$ can be lowered to the normal value by the driving signal control module under the control of the current control module.

During the procedure when the output voltage of the voltage output end $V_{out}$ drops from $V_b$, the output signal of the third operational amplifier $A_3$ of the regulation module returns from the high-level voltage (3.3 V) to the low-level voltage (0 V), so that the first switching transistor $Q_1$ is turned off, while the second switching transistor $Q_2$ is turned on. The non-inverting input end of the second operational amplifier $A_2$ of the short circuit detection module is connected with the negative ends of the LED backlight units once again, and the short circuit detection module can detect the short circuit malfunction of the LED backlight units.

When the short circuit malfunction occurs to one LED backlight unit, the output voltage of the voltage output end $V_{out}$ does not change, and the negative end of the LED backlight unit to which the short circuit malfunction occurs would have the excess voltage $V_e$ resulted from the short circuit malfunction thereof. When the excess voltage $V_e$ is higher than the short circuit protection voltage $V_d$, the output signal of the second operational amplifier $A_2$ of the short circuit detection module jumps from the low-level voltage (0 V) to the high-level voltage (3.3 V), so that the LED backlight unit to which the short circuit malfunction occurs is turned off by the current control module, and other LED backlight units are in the normal work state.

The embodiment of the present disclosure provides an LED backlight driving circuit, which comprises the regulation module. The design difficulty of the LED backlight driving circuit can be reduced by the regulation module, and at the same time, the technical problem of the incorrect detection of the short circuit detection module when the open circuit malfunction occurs to one LED backlight unit and the output voltage of the LED backlight driving circuit rises can be solved.

Further, the embodiment of the present disclosure provides an LED backlight module. In addition to the aforesaid LED backlight driving circuit and LED backlight circuit, the LED backlight module further comprises a light guide plate and a diffusing plate which are used for providing light to the display device.

Moreover, the embodiment of the present disclosure provides a display device comprising the aforesaid LED backlight module, and the display device can be liquid crystal television, liquid crystal display device, mobile phone, tablet personal computer, and so on.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. An LED backlight driving circuit used for driving an LED backlight circuit, the LED backlight circuit comprising at least one LED backlight unit, wherein the LED backlight driving circuit comprises an open circuit detection module that is used for detecting an open circuit malfunction of the LED backlight unit, a short circuit detection module that is used for detecting a short circuit malfunction of the LED backlight unit, and a regulation module; and wherein the regulation module is configured to turn off the short circuit detection module when the open circuit malfunction occurs to the LED backlight unit and an output voltage of a voltage output end of the LED backlight driving circuit rises, and to turn on the short circuit detection module when the LED backlight unit to which the open circuit malfunction occurs is turned off the by the LED backlight driving circuit and the output voltage of the voltage output end of the LED backlight driving circuit declines.

2. The LED backlight driving circuit according to claim 1, wherein an input end of the regulation module is connected with an input end of the open circuit detection module, and an output end of the regulation module is connected with an input end of the short circuit detection module.

3. The LED backlight driving circuit according to claim 2, wherein the open circuit detection module comprises a first resistor, a second resistor, and a first operational amplifier;

wherein one end of the first resistor is connected with one end of the second resistor, the other end of the first resistor is connected with the voltage output end of the LED backlight driving circuit, and the other end of the second resistor is connected with the ground; and wherein an inverting input end of the first operational amplifier is connected with a first voltage end, and a non-inverting input end thereof is connected with a connection position of the first resistor and the second resistor.

4. The LED backlight driving circuit according to claim 3, wherein the short circuit detection module comprises a third resistor, a fourth resistor, and a second operational amplifier;

wherein one end of the third resistor is connected with one end of the fourth resistor, the other end of the third resistor is connected with a second voltage end, and the other end of the fourth resistor is connected with the ground; and wherein an inverting input end of the second operational amplifier is connected with a connection position of the third resistor and the fourth resistor.

5. The LED backlight driving circuit according to claim 4, wherein the regulation module comprises a third operational amplifier, a first switching transistor, and a second switching transistor; and wherein the first switching transistor is an N-type switching transistor, and the second switching transistor is a P-type switching transistor.

6. The LED backlight driving circuit according to claim 5, wherein a non-inverting input end of the third operational amplifier is connected with the connection position of the first resistor and the second resistor, an inverting input end thereof is connected with a third voltage end, and an output end thereof is connected with a first end of the first switching transistor and a first end of the second switching transistor;

wherein a second end of the first switching transistor is connected with the ground, and a third end thereof is connected with a non-inverting input end of the second operational amplifier; and wherein a second end of the second switching transistor is connected with the non-inverting input end of the second operational amplifier, and a third end thereof is connected with one end of the LED backlight unit far from the voltage output end.

7. The LED backlight driving circuit according to claim 6, wherein the first switching transistor is an N-type MOSFET, and the second switching transistor is a P-type MOSFET.

8. The LED backlight driving circuit according to claim 7, further comprising an LED constant current driving circuit, wherein the LED constant current driving circuit comprises a driving signal control module; and wherein the driving signal control module is connected with a gate of a MOSFET, a source of the MOSFET is connected with the ground, and a drain of the MOSFET is connected with the voltage output end of the LED backlight driving circuit.

9. The LED backlight driving circuit according to claim 8, wherein the LED constant current driving circuit further comprises a current control module;

wherein the current control module is connected with each LED backlight unit, an output end of the open circuit detection module, an output end of the short circuit detection module, and the driving signal control module; and wherein the current control module enables the driving signal control module to turn on or turn off the MOSFET according to output signals of the output end of the open circuit detection module and the output end of the short circuit detection module.

10. The LED backlight driving circuit according to claim 9, wherein an inductor is arranged between a voltage input end of the LED backlight driving circuit and the drain of the MOSFET, and a diode is arranged between the drain of the MOSFET and the voltage output end; and wherein the drain of the MOSFET is connected with a positive pole of the diode, and the voltage output end is connected with a negative pole of the diode.

* * * * *